US005158443A

United States Patent [19]

Miyake

[11] Patent Number: 5,158,443

[45] Date of Patent: Oct. 27, 1992

[54] FUEL SPRAYING METHOD IN LIQUID FUEL COMBUSTION BURNER, AND LIQUID FUEL COMBUSTION BURNER

[75] Inventor: Tuneo Miyake, Tokyo, Japan

[73] Assignees: Nippon Oil Co., Ltd.; E.P.S. Engineering Co., Ltd.; Fuji Denki Co., Ltd., all of Tokyo, Japan

[21] Appl. No.: 585,785

[22] Filed: Sep. 20, 1990

[30] Foreign Application Priority Data

Sep. 20, 1989 [JP] Japan ..... 1-241672

[51] Int. Cl.[5] ..... F23D 11/10

[52] U.S. Cl. ..... 431/8; 431/354; 239/433; 239/600; 239/399; 239/419

[58] Field of Search ..... 431/354, 2, 8, 181, 431/185, 175, 345; 239/433, 399, 402, 419.3, 419.5, 419, 600, 567

[56] References Cited

U.S. PATENT DOCUMENTS 2,933,259 4/1960 Raskin ..... 239/419 X
4,337,898 7/1982 Cleall ..... 239/433 X
4,356,970 11/1982 Vosper et al. ..... 239/8
4,601,428 7/1986 Kurogo ..... 431/354 X

FOREIGN PATENT DOCUMENTS 0092002 10/1983 European Pat. Off. .
0149901 7/1985 European Pat. Off. .
509383 11/1920 France .
57145611 2/1956 Japan .
1377382 12/1974 United Kingdom .

*Primary Examiner*—Carl D. Price
*Attorney, Agent, or Firm*—Nils H. Ljungman and Associates

[57] ABSTRACT

Disclosed is a liquid spraying method in a liquid combustion burner, in which a liquid fuel is sprayed together with an atomization-promoting fluid mixed into the liquid fuel, and also a liquid fuel combustion burner is disclosed. In this liquid fuel spraying method and this liquid fuel combustion burner, only the liquid fuel is turned while the atomization-promoting fluid is not turned, whereby the frictional energy between the atomization-promoting fluid and the liquid fuel is reduced and hence, formation of $NO_x$ is controlled.

21 Claims, 6 Drawing Sheets

FUEL SPRAYING METHOD IN LIQUID FUEL COMBUSTION BURNER, AND LIQUID FUEL COMBUSTION BURNER

BACKGROUND OF THE INVENTION

1. Field of the Invention

The present invention relates to a fuel spraying method in a liquid fuel combustion burner used as a heat source of a boiler, a heating furnace and the like, and a liquid fuel combustion burner. More particularly, the present invention relates to a fuel spraying method in a liquid fuel combustion burner having a structure in which a liquid fuel is sprayed together with a fluid flow of air, steam or misty water droplets (hereinafter referred to as "atomization-promoting fluid" or "division promoting fluid") which is mixed in with the liquid fuel, and a liquid fuel combustion burner.

2. Description of the Related Art

A liquid fuel combustion burner having a structure in which a liquid fuel is mixed with an atomization-promoting fluid such as steam or air and this mixed fluid is sprayed from a plurality of injection holes is known.

According to the fuel spraying method adopted for this liquid fuel combustion burner, the liquid fuel to be mixed with the spraying medium is atomized and diffused by the expansion energy generated when an atomization-promoting fluid such as steam or air is injected to a low-pressure side from a high-pressure side.

In regard to the above-mentioned spraying method, two mixing methods are known, an internal mixing method in which the injection quantity is controlled while maintaining a certain difference between the pressure of the atomization-promoting fluid and the pressure of the liquid fuel, and an intermediate mixing method in which the pressure of the liquid fuel is changed while maintaining the pressure of the atomization-promoting fluid at a certain level, whereby the injection quantity is controlled.

The intermediate mixing method is advantageous over the internal mixing method in that the consumption of the atomization-promoting fluid is small and a good atomizing effect is attained.

However, this spraying method is defective in that since the liquid fuel, which is an incompressible fluid, has no substantial dispersing force, the atomization-promoting fluid should be maintained at a high temperature and a high pressure.

As the means for solving this problem, there has been proposed a technique of giving a turning or swirling movement to the atomization-promoting fluid and liquid fuel. The centrifugal force generated by this turning motion promotes atomization and diffusion of the liquid fuel and improves the combustion state (see Japanese Unexamined Utility Model Publication No. 57-145116).

According to this conventional technique, the mixing of the liquid fuel with air and the atomization of the fluid are promoted, not only by the expansion energy generated when steam is injected to a low-pressure side from a high-pressure side, but also by the centrifugal force generated by the turning movement. The liquid fuel also becomes uniformly diffused over a broad range.

Recently, exhaust gas regulations for combustion apparatuses became severe, and reduction of a level of nitrogen oxides (hereinafter referred to as "$NO_x$") produced by combustion is therefore an important problem.

Various experiments were done with the above-mentioned conventional liquid fuel combustion burner, and it was found that since the flame layer becomes thick and large and the heat dissipation is degraded, the flame temperature rises, the residence time in a high-temperature zone becomes long and it is difficult to reduce the level of $NO_x$.

The reason it is difficult to reduce the $NO_x$ level produced by the conventional burner is that in the conventional liquid fuel combustion burner a plurality of injection holes are arranged equidistantly or substantially equidistantly and, thus, the flame layer becomes thick and large and the heat dissipation is degraded.

Moreover, since both of the liquid fuel and the atomization-promoting fluid or division promoting fluid, such as steam are simultaneously turned, the frictional energy between the steam and the liquid fuel is increased.

Accordingly, the consumption of the atomization-promoting fluid, such as steam, increases and, thus, it becomes necessary to elevate the heating temperature of the liquid fuel, with the resultant increase of $NO_x$ in the exhaust gas.

OBJECT OF THE INVENTION

The object of the present invention is to promote the atomization and diffusion of the liquid fuel and to reduce the level of $NO_x$ in the exhaust gases while reducing the consumption of the spraying medium.

SUMMARY OF THE INVENTION

The present invention has been completed under this background to solve the foregoing problems of the conventional techniques. Namely, the present invention relates to a fuel spraying method in a liquid fuel combustion burner, in which a liquid fuel is sprayed together with an atomization-promoting fluid or a division promoting fluid which is mixed in with the liquid fuel, and a liquid fuel combustion burner.

More specifically, in accordance with the present invention there is provided a fuel spraying method in a liquid fuel combustion burner, which comprises turning or swirling a liquid fuel in a flow passage having a sectional area restricted for constraining a flow of the liquid fuel, introducing atomization-promoting fluid into the flow passage and spraying a mixed fluid of the liquid fuel and the atomization-promoting fluid from said flow passage.

According to this method, the liquid fuel to be mixed with the atomization-promoting fluid is atomized and uniformly diffused by the expansion energy generated when the atomization-promoting fluid is injected to a low-pressure side from a high-pressure side. Furthermore, a turning movement is given to the liquid fuel and the centrifugal force generated by this turning movement further promotes the atomization and diffusion of the liquid fuel and causes the liquid fuel to be uniformly diffused over a broad area.

Since only the liquid fuel is turned and the atomization-promoting fluid is not turned, the frictional energy between the atomization-promoting fluid and the liquid fuel is reduced, and hence, the consumption of the atomization-promoting fluid can be reduced. Since the consumption of the atomization-promoting fluid is reduced, the heating temperature for the liquid fuel does not need to be elevated and hence, generation of $NO_x$ can be reduced.

In accordance with another aspect of the present invention, there is provided a liquid fuel combustion burner, which is attached to the top end portion of a tube for being projected into the interior of a combustion apparatus. The assembly has a structure in which a liquid fuel supplied through a fuel passage formed in the interior of the tube is sprayed into the interior of the combustion apparatus together with an atomization-promoting fluid supplied through atomization-promoting fluid passages formed in the interior of the tube and which atomization-promoting fluid is mixed with the fuel. The burner comprises a liquid fuel supply passage, a plurality of injection holes, branch passages branched from the liquid fuel supply passage, an annular passage communicating with the downstream end of the branch passages and located around the downstream end of the atomization-promoting fluid supply passages, connecting passages connecting the downstream end of the atomization-promoting fluid supply passages to the injection holes, and a burner proper having connecting passages connecting the downstream end of the liquid fuel supply passage and the annular passage to side portions of the respective injection holes.

In the burner having the above-mentioned structure, the liquid fuel flows into the liquid fuel supply passage and the branch passages.

The liquid fuel which has flowed into the liquid fuel supply passage arrives at the connecting passages through the downstream end of the liquid fuel supply passage and is injected into the interior of the injection holes from the side position of the injection hole to which the connecting passages open.

The liquid fuel which has flowed into the branch passages arrives at the connecting passages through the annular passage and is injected into the interior of the injection holes from the side position of the injection hole to which the connecting passage opens.

The atomization-promoting fluid flows into the atomization-promoting fluid supply passages from where it passes through the connecting passages and is injected into the interior of the injection holes from the downstream end of the injection holes to which the connecting passages open.

Since the direction of the connection of the connecting passages to the side portion of the injection holes is made in agreement with the tangential direction of the injection holes, the liquid fuel injected from the side portion of the injection holes is formed into a turning stream.

The plurality of injection holes are divided into a plurality of groups, each group consisting of two injection holes, and respective groups are arranged at a plurality of positions, separated from one another by predetermined angles in the circumferential direction with the central axis of the burner proper being as the center. Two injection holes of each group can be arranged so that they are brought close to each other in the circumferential direction with the central axis of the burner proper being as the center.

If this embodiment is adopted, the flame can be divided into a plurality of independent small flames which can be formed in the discrete state.

Therefore, the heat dissipation is enhanced, and the flame temperature can be reduced, and since the flame layer becomes thin, the residence time of the gas in a high-temperature zone can be shortened, with the result that formation of $NO_x$ can be controlled.

It is especially preferred that the injection holes of each group be arranged contiguously to each other so that the central axes of the injection holes form a crossing angle smaller the 20° or so that they are parallel to one another. Therefore, $NO_x$ can be effectively controlled.

According to the preferred embodiment, the burner proper comprises a fuel supply member and a burner tip connected to the top end of the fuel supply member, a liquid fuel supply passage, atomization-promoting fluid supply passages, branch passages, a plurality of injection holes formed in the fuel supply member, connecting passages connecting the atomization-promoting fluid supply passage to the injection holes, an annular passage, and a connecting passage connecting the downstream end of the liquid fuel supply passage and the annular passage to the injection holes of the burner tip. If this embodiment is adopted, the productivity of the burner proper can be improved, and mass production and reduction of the cost become possible.

Preferably, the fuel supply member is formed of a substantially columnar member having a surface of a circular cone on the top end.

According to this embodiment, the productivity and reduction of price become possible.

Furthermore, in the fuel supply member, a liquid fuel supply passage is preferably formed from the top end through to the rear end portions thereof.

According to this embodiment, the productivity and reduction of price become possible.

Moreover, it is preferred that a plurality of branch passages be formed in the fuel supply member so that the branch passages extend obliquely upward from the rear end of the liquid fuel supply passage and open to the top end face of the fuel supply member.

According to this embodiment, the productivity and reduction of price become possible.

Still further, it is preferred that in the fuel supply member, a plurality of small-diameter holes be formed such that the holes extend obliquely from positions close to the rear end of the liquid fuel supply passage on the rear end face of the fuel supply member to near the top end face of the fuel supply member. These holes are then intersected by a smaller hole orthogonal to the end face.

According to this embodiment, the productivity and reduction of price become possible.

Still in addition, it is preferred that an engaging pin be driven into the peripheral part of the top end face of the fuel supply member and that the engaging pin be positioned for engaging an engaging hole formed on the rear face of the burner tip to thus engage the fuel supply member with the burner tip.

According to this embodiment, the productivity and reduction of price become possible.

It is preferred that a recess capable of being engaged with the top end portion of the fuel supply member be formed on the rear face of the burner tip and that the burner tip be formed to have substantially a shape of a circular cone.

According to this embodiment, the productivity and reduction of price become possible.

Moreover, it is preferred that a circular recess be formed at a central part of the inner face of the burner tip, an annular passage be formed in the peripheral portion of said inner face, and a plurality of injection holes be formed from the top end face of the burner tip in a direction orthogonal to said top end face and opening to the interior of the engaging portion between said annular passage and said circular recess.

According to this embodiment, the productivity and reduction of price become possible.

Furthermore, it is preferred that between an injection hole-opening portion on the inner face of the burner tip and circular recess formed at a central part of the inner face of the burner tip, a connecting passage connecting the injection hole and the circular recess be formed, and a connecting passage connecting the injection hole to the annular passage be formed between the opening of the injection hole and the annular passage.

According to this embodiment, the productivity and reduction of price become possible.

Still further, it is preferred that between an injection hole-opening portion on the top end face of the fuel supply member and a circular recess formed at a central part of the top end face of the fuel supply member, a connecting passage connecting the injection hole to the circular recess be formed, and a connecting passage connecting the injection hole and the annular passage be formed between the opening of the injection hole and the annular passage.

The burner proper can comprise a fuel supply member and a burner tip to be engaged with the top end portion of the fuel supply member, which fuel supply member comprises, a liquid fuel supply passage, an atomization-promoting fluid supply passage, branch passages, a part of a plurality of injection holes, a connecting passage connecting the atomization-promoting fluid supply passage with the part of the injection holes, an annular passage and connecting passages connecting the downstream end of the liquid fuel supply passage and the annular passage to the part of the injection holes. The remainder of the plurality of injection holes are formed in the burner tip. According to this embodiment, the productivity of the burner proper is increased, and mass production and reduction of the price become possible. Since it is sufficient to form connecting passages on the top face of the fuel supply member by machining, there can be attained an advantage in that the machining operation can be performed simply and easily.

It is preferred that a circular recess be formed at a central part of the top end face of the fuel supply member, an annular passage be formed in the peripheral portion of the inner face of the fuel supply member, and a connecting portion of a plurality of injection holes pierced from the top end face of the burner tip in a direction orthogonal to said top end face be formed between the annular passage and the circular recess.

According to this embodiment, the productivity and reduction of price become possible.

Furthermore, it is preferred that a connecting passage be formed between the injection hole-connecting portion of the fuel supply member, the circular recess be formed at the central part of the fuel supply member to connect the injection opening- connecting portion to the circular recess, and a connecting passage be formed between the injection hole-connecting portion and the annular passage to connect the injection hole-connecting portion to the annular passage.

According to this embodiment, the productivity and reduction of price become possible.

One feature of the invention resides broadly in a fuel spraying method in a liquid fuel combustion burner, which comprises turning a liquid fuel in a flow passage having a sectional area restricted for constraining a flow of the liquid fuel, introducing atomization-promoting fluid to said flow passage and spraying a mixed fluid of the liquid fuel and the atomization-promoting fluid from said flow passage.

An additional feature of the invention resides broadly in a liquid fuel combustion burner, which is attached to the top end portion of a tube projected into the interior of a combustion apparatus proper and has a structure in which a liquid fuel supplied through a fuel passage formed in the interior of the tube is sprayed into the interior of the combustion apparatus proper together with an atomization-promoting fluid supplied through an atomization-promoting fluid passage formed in the interior of tube and mixed with the fuel, said burner comprising a liquid fuel supply passage, a plurality of injection holes, a branch passage branched from the liquid fuel supply passage, an annular passage communicating with the downstream end of the branch passage and located around the downstream end of the atomization-promoting fluid supply passage, a connecting passage connecting the downstream end of the atomization-promoting fluid supply passage to the injection holes, and a burner proper having a connecting passage connecting the downstream end of the liquid fuel supply passage to the annular passage and the side portions of the respective injection holes.

A further feature of the invention resides broadly in a method of spraying fluid fuel from a fluid fuel combustion nozzle, the method comprising the steps of: introducing the fluid fuel into a flow passage of the fluid fuel combustion nozzle, swirling the fluid fuel in the flow passage, introducing a division-promoting fluid into the flow passage to divide the fluid fuel and form a mixed fluid of the division-promoting fluid and the fluid fuel, and spraying the mixed fluid out of the flow passage.

A yet further feature of the invention resides broadly in a fluid fuel spray nozzle for use in a boiler, a heating furnace or the like, the fluid fuel spray nozzle comprising: at least one fluid fuel supply passage, at least one division-fluid supply passage, at least one injection passage aligned with the at least one division-fluid supply passage, at least one connecting passage connecting the at least one fuel supply passage to the at least one injection passage, the at least one connecting passage substantially tangentially connected to the at least one injection passage, at least one of: the at least one connecting passage and the at least one injection passage comprising apparatus for producing swirling of the fluid fuel upon the fluid fuel being introduced into the at least one injection passage through the at least one connecting passage from the at least one fuel supply passage.

The present invention will now be described in detail with reference to embodiments illustrated in the accompanying drawings, from which the present invention will be clearly understood. However, the scope of the present invention is not limited by these embodiments, but modifications can be freely made within the scope defined by the claims.

DESCRIPTION OF THE PREFERRED EMBODIMENTS

Figure 1:
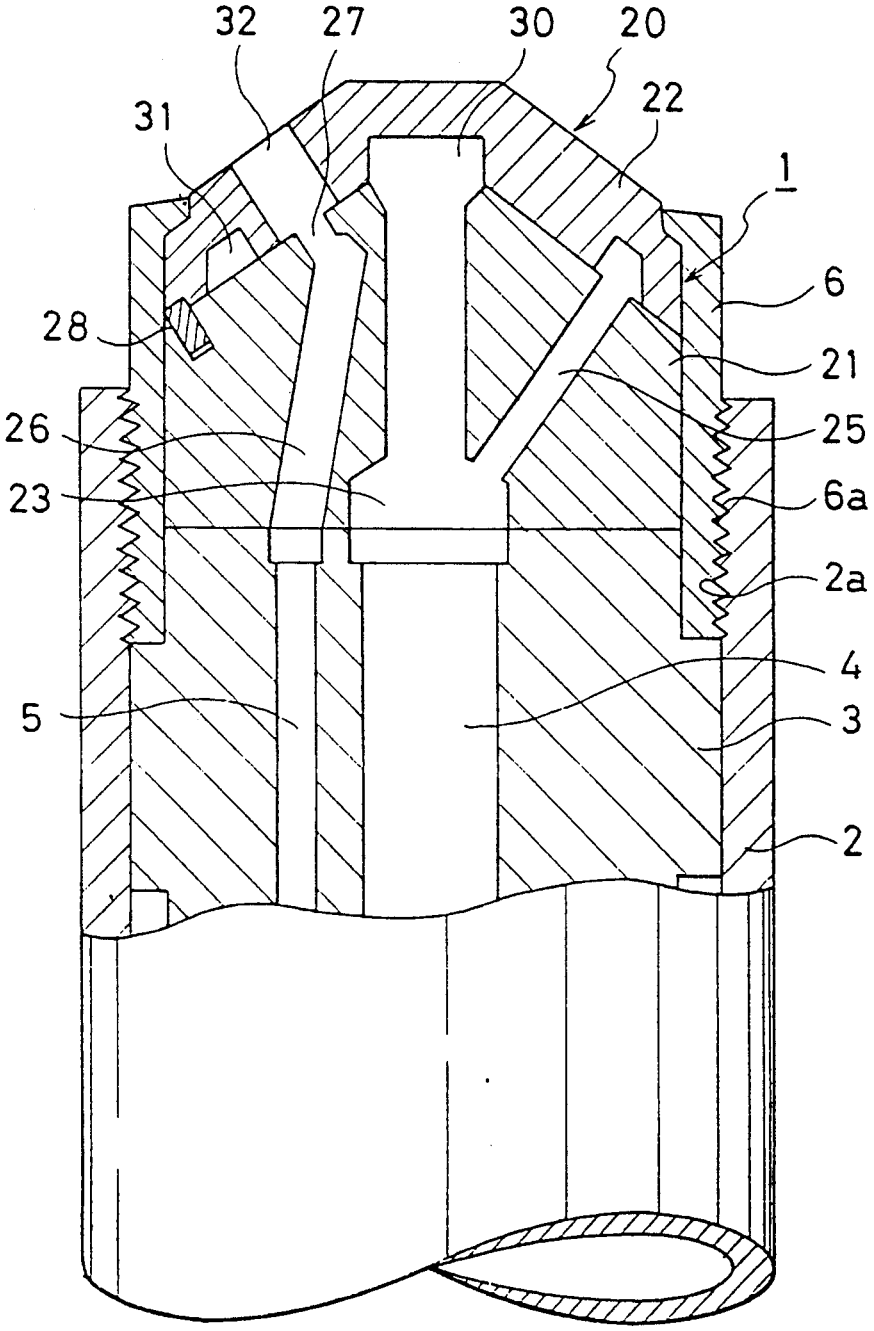
FIG. 1 is a sectional view illustrating the state of attachment of the liquid fuel combustion burner according to the present invention.

FIG. 1 is a sectional view illustrating the attachment of the liquid fuel combustion burner according to the present invention. A liquid fuel combustion burner 1 is inserted through the peripheral wall of a furnace proper as a combustion apparatus proper not shown in the drawings and is used in the state where the top end side of the burner 1 is fixed to the top end portion of a guide pipe 2 projected into the interior of the furnace proper. An adapter 3 is inserted and fixed in the guide pipe 2, and in the adapter 3, there are formed passages 4 and 5 which are respectively connected to a fuel supply pipe and an atomization-promoting fluid supply pipe, which are extended from a fuel supply source and an atomization-promoting fluid supply source, not shown in the drawings. A cylindrical cap 6 is engaged with a proper 20 of the burner 1 in the state where the top end face of the burner proper 20 is projected, and by fitting male screw 6*a* formed on the peripheral face of the cap 6 to a female screw 2*a* formed on the inner circumferential face of the guide pipe 2, the burner proper 20 is fixed to the top end portion of the guide pipe 2. In this attachment state of the burner proper 20, the passages 4 and 5 respectively communicating with the fuel supply pipe and the atomization-promoting fluid supply pipe are connected to a fuel supply hole 23 and an atomization-promoting fluid supply hole 26, described hereinafter, of the burner proper 20.

The burner proper 20 comprises a fuel supply member 21 and a burner tip 22 connected to the top face of the fuel supply member 21. The fuel supply member 21 is formed of a substantially columnar body having a top end face of a circular cone.

The liquid fuel supply hole 23 is formed to pierce a central part of the fuel supply member 21 along the central axis thereof.

In the fuel supply member 21, a plurality of branch holes 25 are formed so that the branch holes 25 extend obliquely upward from a large-diameter portion formed at the rear end of the liquid fuel supply hole 23 and open to the top end face of the liquid fuel supply member 21.

A plurality of atomization-promoting fluid supply holes 26 are formed in the fuel supply member 21 so that the atomization-promoting fluid supply holes 26 extend obliquely from the position close to the large-diameter portion of the liquid fuel supply hole 23 while approaching the liquid fuel supply hole 23, and the holes 26 communicate with a plurality of small-diameter holes 27 pierced in the top end face of the fuel supply member 21 from a direction orthogonal to said top end face, respectively.

Figure 2:
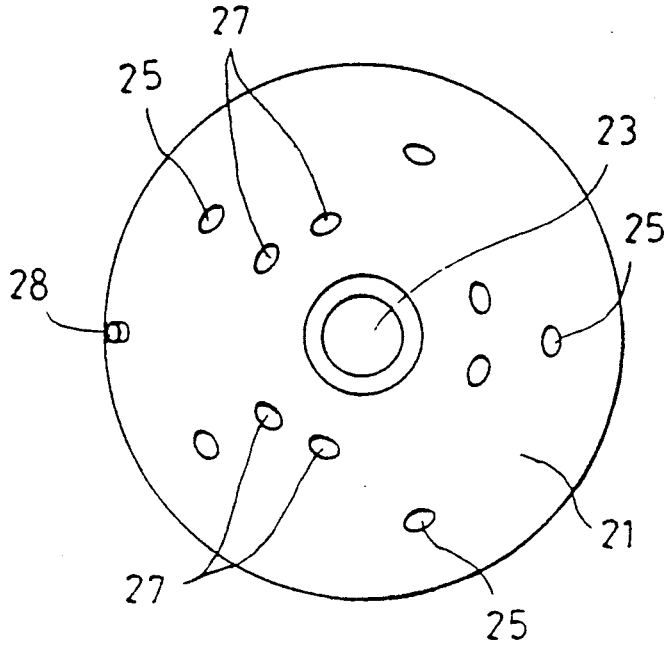
FIG. 2 is a plan view showing a fuel supply member of the burner proper shown in FIG. 1.

In this embodiment, as shown in the plan view of the fuel supply member in FIG. 2, the small-diameter holes 27 are arranged between the liquid fuel supply hole 23 and the branch holes 25 on the top end face of the fuel supply member 21.

An engaging pin 28 is driven in the peripheral portion of the top end face of the fuel supply member 21, and by engaging this engaging pin 28 with an engaging hole 36 formed on the rear face of the burner tip 22 (see FIG. 4), the fuel supply member 21 and the burner tip 22 are fixed together.

Figure 3:
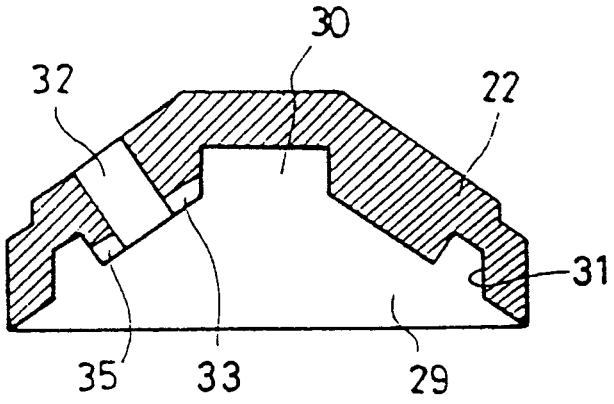
FIG. 3 is a sectional view of a burner tip of the burner proper shown in FIG. 1, which shows the section taken along the line III—III in FIG. 4.
Figure 4:
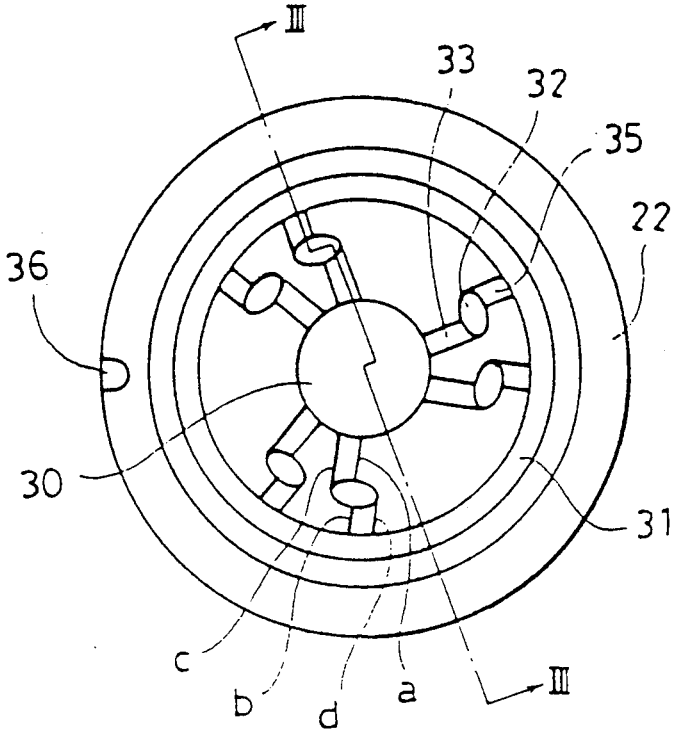
FIG. 4 is a bottom view of a burner tip of the burner proper shown in FIG. 1.

As shown in the sectional view of the burner tip in FIG. 3 and the bottom view of the burner tip in FIG. 4, a fitting portion 29 capable of engaging with the top end portion of the above-mentioned fuel supply member is formed as a recess on the rear face of the burner tip 22, and the burner tip 22 is formed to have substantially a shape of a circular cone as a whole.

A circular recess 30 is formed at a central part of the inner face of the fitting portion 29 of the burner tip 22 and an annular groove 31 is formed on the periphery of the inner face of the fitting portion 29. A plurality of injection holes 32 pierced from the top end face of the burner tip 22 in a direction orthogonal to the end face and opened to the inner face of the fitting portion 29 are formed between the annular groove 31 of the fitting portion 29 and the circular recess 30.

A communicating groove 33 connecting the injection holes 32 to the circular recess 30 is formed between the openings of the injection holes 32 on the inner face of the fitting portion 29 and circular recess 30. Furthermore, a communicating groove 35 connecting the injection holes 32 to the annular groove 31 is formed between the openings of the injection holes 32 on the inner face of the fitting portion 29 and the annular groove 31.

One side wall a of communicating grooves 33 and one side wall b of communicating groove 35 are located substantially on a line passing through the centers of the injection holes 32. The other side walls c and d of the communicating grooves 33 and 35 are parallel to the side walls a and b and are located on a line along the tangential direction of the injection holes 32.

In the above-mentioned structure, the connecting directions of the communicating grooves 33 and 35 to the side portions of the injection holes 32 are made in agreement with the tangential direction of the injection holes 32.

Figure 5:
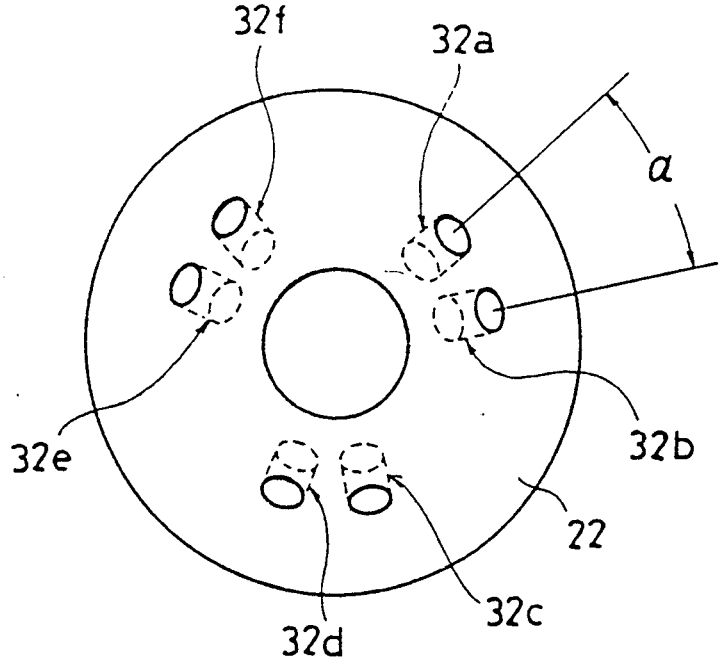
FIG. 5 is a plan view of a burner tip of the burner proper shown in FIG. 1, which illustrates an example of the arrangement of injection holes.

Referring to the plan view of the burner tip in FIG. 5, the arrangement of the injection holes 32, which is one of the characteristic features of the present invention, will now be described in detail.

Namely, six injection holes 32*a* through 32*f* are arranged and divided into three groups, that is, a group of injection holes 32*a* and 32*b*, a group of injection holes 32*c* and 32*d* and a group of injection holes 32*e* and 32*f*. These groups are arranged at three positions spaced by 120° from one another with the central axis of the burner tip 22 being the center. In each group, the injection holes 32*a* and 32*b*, 32*c* and 32*d* or 32*e* and 32*f* are arranged adjacently to one another so that the central axes of these injection holes cross each other at a predetermined angle $\alpha$ (smaller than 20°).

Incidentally, in each group, the injection holes 32*a* and 32*b*, 32*c* and 32*d* or 32*e* and 32*f* can be arranged adjacently to each other so that the central axes of these injection holes are parallel to one another.

The function of the liquid fuel combustion burner having the above-mentioned structure will now be described. A liquid fuel supplied to the fuel supply member 21 flows from the rear end of the fuel supply member 21 into the liquid fuel supply hole 23 and the branch hole 25.

The liquid fuel which has flowed into the liquid fuel supply hole arrives at the communicating groove 33 through the circular recess 30 of the burner tip 32 and is injected into the interior of the injection hole 32 from the position on the inner circumferential face of the injection hole 32 to which the communicating groove 33 opens.

The liquid fuel which has flowed into the branch hole 25 arrives at the communicating groove 35 through the annular groove 31 of the burner tip 32 and is injected into the interior of the injection hole 32 from the position of the inner circumferential face confronting to the position of the opening of the communicating groove 33 of the injection hole 32, to which the communicating groove 35 opens.

Steam, as the atomization-promoting fluid, flows into the atomization-promoting fluid supply hole 26 from the rear end portion of the fuel supply member 21. From the atomization-promoting fluid supply hole 26, the steam arrives at the small-diameter hole 27 and is injected into the interior of the injection hole 32 from the position on the rear end face of the injection hole 32 to which the small-diameter hole 27 opens.

Since side walls a and b of the communicating grooves 33 and 35 are formed to pass substantially through the center of the injection hole 32 and the other side walls c and d are formed so that they are parallel to side walls a and b and located in the tangential direction of the injection hole 32, the liquid fuel is injected from two confronting positions on the inner circumferential face of the injection hole 32, and each injected liquid fluid is formed into a turning stream.

Steam is injected to these turning streams of the liquid fluid, the liquid fuel is mixed with the steam, and the mixture is sprayed from the injection hole 32. At this point, the liquid fuel mixed with steam is atomized and uniformly diffused by the expansion energy generated when the steam is injected to a low-pressure side from a high-pressure side. Furthermore, a turning movement is given to the liquid fuel, and the centrifugal force generated by this turning movement further promotes atomization and diffusion of the liquid fuel and causes the liquid fuel to be uniformly diffused over a broad range.

Since only the liquid fuel is turned and the steam is not turned, the frictional energy between the steam and the liquid fuel is reduced, the consumption of steam can be reduced, and this reduction of the consumption of steam makes it unnecessary to elevate the temperature for heating the liquid fuel and therefore, formation of $NO_x$ can be controlled.

Moreover, since the injection holes 32*a* through 32*f* are divided into three groups, the injection holes of respective groups are arranged at three positions separated from one another by 120° and in each group, the injection holes 32*a* and 32*b*, the injection holes 32*c* and 32*d* and the injection holes 32*e* and 32*f* are arranged adjacently to each other so that the central axes of the injection holes cross each other at a predetermined angle $\alpha$ (smaller than 20°) or they are parallel to each other, the flame can be divided into a plurality of small independent flames in the discrete state, and therefore, a good heat dissipation can be attained and the flame temperature can be lowered. Moreover, the flame layer becomes thin and the residence time of gas in a high-temperature zone can be shortened, and therefore, formation of $NO_x$ can be effectively controlled.

The effects of the above-mentioned liquid fuel combustion burner of the present invention will be readily understood from the experimental results shown in Tables 1 through 4. It is obvious that the $NO_x$ concentration and the soot quantity can be drastically reduced.

TABLE 1

| | Conventional Burner Invention | Burner of Present |
|---|---|---|
| capacity of boiler | 3 t/h | 3 t/h |
| spraying method | internal mixing | intermediate mixing |
| number of burners | 1 | 1 |
| size of injection holes | ϕ1.7 × 8 holes (FIG. 10-a) | ϕ2.6 × 6 holes (parallel) |
| fuel oil | kerosene | kerosene |
| combustion oil quantity | 280 l/h | 280 l/h |
| spraying oil pressure | 2.7 kg/cm$^2$ | 4.7 kg/cm$^2$ |
| spraying steam pressure | 2.1 kg.cm$^2$ | 4.6 kg/cm$^2$ |
| $NO_x$ concentration | 80 ppm | 40 ppm |
| exhaust gas $O_2$ level | 2.9% | 3.0% |
| smoke concentration | 0.5–1.0 | 0 |

TABLE 2

| | Conventional Burner Invention | Burner of Present |
|---|---|---|
| capacity of boiler | 85 t/h | 85 t/h |
| spraying method | internal mixing | intermediate mixing |
| number of burners | 4 | 4 |
| size of injection holes | ϕ3.5 × 8 holes (FIG. 10-b) | ϕ4.7 × 6 holes (parallel) |
| fuel oil | fuel oil C | fuel oil C |
| combustion oil quantity | 6000 l/h | 6000 l/h |
| spraying oil pressure | 7.4 kg/cm$^2$ | 8.0 kg/cm$^2$ |
| spraying steam pressure | 9.0 kg.cm$^2$ | 9.4 kg/cm$^2$ |
| $NO_x$ concentration | 223 ppm | 173 ppm |
| exhaust gas $O_2$ level | 3.9% | 4.1% |
| smoke concentration | 5.0 | 3.5 |

TABLE 3

| | Conventional Burner Invention | Burner of Present |
|---|---|---|
| capacity of boiler | 50 t/h | 50 t/h |
| spraying method | internal mixing | intermediate mixing |
| number of burners | 3 | 3 |
| size of injection holes | ϕ3.9 × 4 holes (FIG. 10-c) | ϕ4.2 × 6 holes ($\alpha$= 7.5° C.) |
| fuel oil | fuel oil C | fuel oil C |
| combustion oil quantity | 3774 l/h | 3786 l/h |
| spraying oil pressure | 10.5 kg/cm$^2$ | 10.6 kg/cm$^2$ |
| spraying steam pressure | 10.7 kg.cm$^2$ | 10.7 kg/cm$^2$ |
| $NO_x$ concentration | 202 ppm | 182 ppm |
| exhaust gas | 1.1% | 1.0% |

TABLE 3-continued

| | Conventional Burner Invention | Burner of Present |
|---|---|---|
| $O_2$ level | | |
| smoke concentration | 0 | 0 |
| soot quantity | 40–80 kg/day | 20–30 kg/day |

TABLE 4

| | Conventional Burner Invention | Burner of Present |
|---|---|---|
| capacity of boiler | 120 t/h | 120 t/h |
| spraying method | internal mixing | intermediate mixing |
| number of burners | 6 | 6 |
| size of injection holes | ϕ4.9 × 5 holes (FIG. 10-d) | ϕ6.2 × 6 holes (α = 15° C.) |
| fuel oil | fuel oil C | fuel oil C |
| combustion oil quantity | 8800 l/h | 8800 l/h |
| spraying oil pressure | 8.2 kg/cm$^2$ | 8.4 kg/cm$^2$ |
| spraying steam pressure | 5.4 kg.cm$^2$ | 5.6 kg/cm$^2$ |
| $NO_x$ concentration | 230 ppm | 180 ppm |
| exhaust gas $O_2$ level | 1.8% | 1.2% |
| smoke concentration | 0–0.5 | 0–0.5 |

If the crossing angle between the central axes of the injection holes is larger than 20° (for example, 25°), as shown in Table 5, the $NO_x$ concentration and the soot quantity are larger than those attained when this angle is smaller than 20°. Accordingly, it is obvious that particular effects are attained in the present invention by arranging the injection holes adjacently to each other so that the central axes of the injection holes cross each other at an angle smaller than 20° or they are parallel to each other.

TABLE 5

| | Burner of Present Invention |
|---|---|
| capacity of boiler | 120 t/h |
| spraying method | intermediate mixing |
| number of burners | 6 |
| size of injection holes | ϕ6.2 × 6 holes (α = 25° C.) |
| fuel oil | fuel oil C |
| combustion oil quantity | 8800 l/h |
| spraying oil pressure | 8.4 kg/cm$^2$ |
| spraying steam pressure | 5.6 kg.cm$^2$ |
| $NO_x$ concentration | 210 ppm |
| exhaust gas | 1.5% |
| $O_2$ level | 1.5% |
| smoke concentration | 0–0.5 |

Incidentally, in Tables 1 through 4, the conventional burners are those in which the injection holes are arranged as shown in FIGS. 10*a* through 10*d*.

Another of the present invention will now be described with reference to FIGS. 6 and 7.

Figure 6:
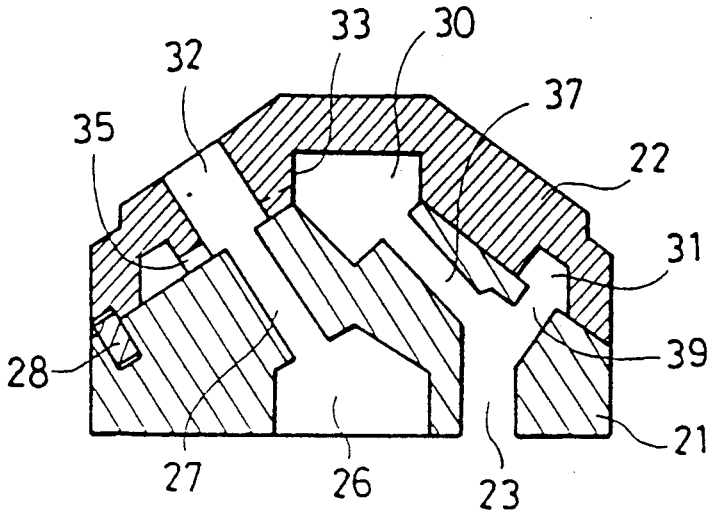
FIG. 6 is a sectional view illustrating another embodiment of the liquid fuel combustion burner according to the present invention.
Figure 7:
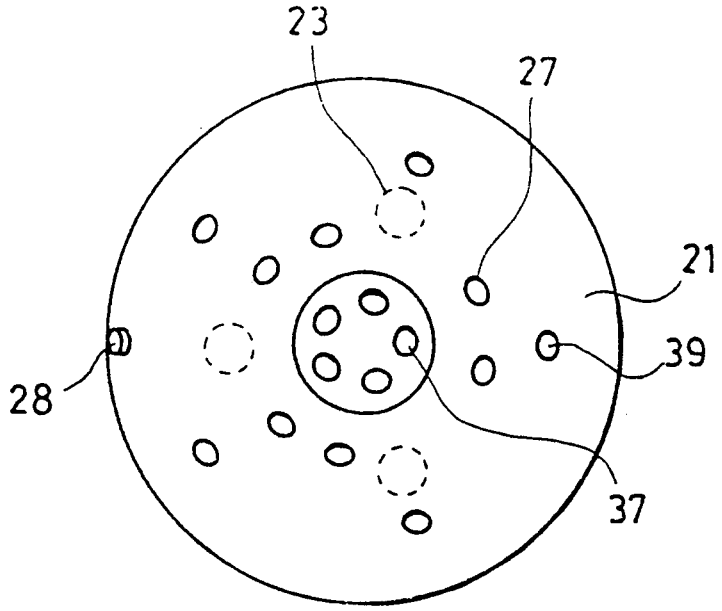
FIG. 7 is a plan view of a fuel supply member of the burner shown in FIG. 6.

In the embodiment of FIGS. 6 and 7, in the fuel supply member 21, the liquid fuel supply hole 23 and atomization-promoting fluid supply hole 26 are arranged in a positional relation reverse to that shown in FIGS. 1 through 4.

Namely, the atomization-promoting fluid supply hole 26 is formed at the central part of the rear end face of the fuel supply member 21, and a plurality of small-diameter holes 27 connecting the atomization-promoting fluid supply hole 26 to the injection hole 32 are formed. A plurality of liquid fuel supply holes 23 are formed in the periphery of the atomization-promoting fluid supply hole 26, and a first branch hole 37 and a second branch hole 39 branched from the liquid fuel supply hole 23 in two different directions are formed.

The first branch hole 37 communicates with the circular recess 30 of the burner tip 22, and the second branch hole 39 communicates with the annular groove 31 of the burner tip 22.

The function of the present embodiment will now be described.

The liquid fuel supplied to the fuel supply member 21 follows into the liquid fuel supply hole 23 from the rear end portion of the fuel supply member 21.

The liquid fluid which has flowed into the liquid fuel supply hole 23 is introduced into the first branch hole 37 and the second branch hole 39. The liquid fuel which has flowed into the first branch hole 37 arrives at the communicating groove 33 through the circular recess 30 and is injected into the interior of the injection hole 32 from the position on the inner circumferential face of the injection hole 32, to which the communicating groove 33 opens.

The liquid fuel which has flowed into the second branch hole 39 arrives at the communicating groove 35 through the annular groove 31 and is injected into the interior of the injection hole 32 from the position of the inner circumferential face confronting to the position of the opening of the communicating groove 33 of the injection hole 32, to which the communicating groove 35 opens.

Steam flows into the atomization-promoting fluid supply hole 26 from the rear end portion of the fuel supply member 21 and is injected into the interior of the injection hole 32 from the position on the rear end face of the injection hole 32 to which the small-diameter hole 27 opens, through the small-diameter hole 27.

Also in the present embodiment, the liquid fuel injected from the two confronting positions on the inner circumferential face of the injection hole 32 is formed into turning streams, while steam is not turned.

Figure 8:
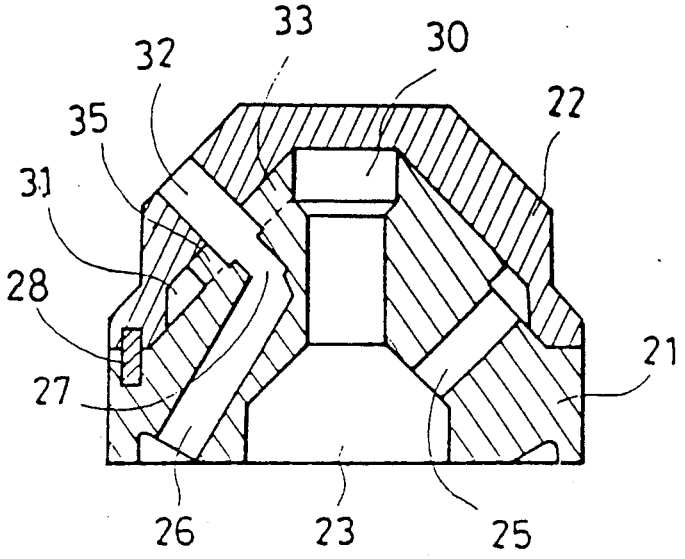
FIG. 8 is a sectional view illustrating still another embodiment of the liquid fuel combustion burner according to the present invention.
Figure 9:
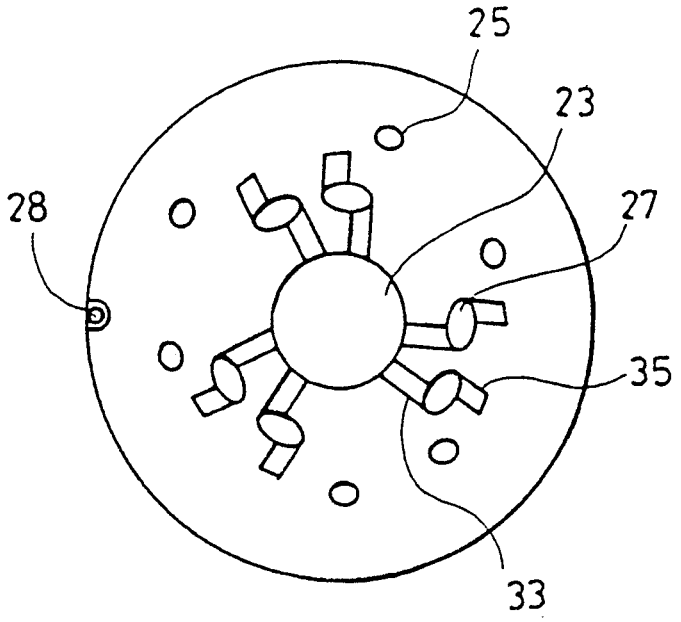
FIG. 9 is a plan view of a fuel supply member of the burner shown in FIG. 8.
Figure 10A:
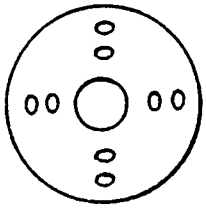
FIGS. 10*a*–10*d* are a plan views illustrating the arrangement of injection holes in the conventional burner.
Figure 10B:
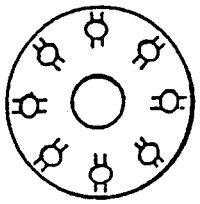
Figure 10C:
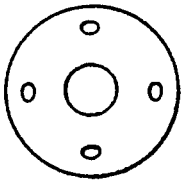
Figure 10D:
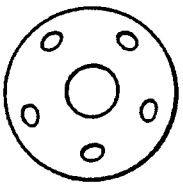

Still another example of the present invention will now be described with reference to FIGS. 8 and 9.

In the present embodiment, the communicating grooves 33 and 35, which are formed on the side of the burner tip 22 in the embodiment shown in FIGS. 1 through 4, are formed on the side of the fuel supply member 21.

Accordingly, in the present embodiment, it is sufficient if the communicating grooves 33 and 35 are formed on the top face of the fuel supply member 41 by matching. Therefore, the present embodiment is advantageous in that the machining operation can be performed simply and easily.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A liquid fuel combustion burner for being attached to a top end portion of a tube for being projected into a combustion apparatus proper, the tube having an interior, and the combustion burner having a structure in which a liquid fuel supplied through a fuel passage formed in the interior of the tube is sprayed into the combustion apparatus proper together with an atomization-promoting fluid supplied through an atomization-promoting fluid passage formed in the interior of the tube and mixed with the fuel, said burner comprising:

a liquid fuel supply passage, the liquid fuel supply passage having a downstream end;

an atomization-promoting fluid supply passage, the atomization-promoting fluid supply passage having a downstream end;

a plurality of injection holes, each of the plurality of injection holes having a central axis and side portions disposed about the central axis;

a branch passage branched from the liquid fuel supply passage, the branch passage having a downstream end;

an annular passage communicating with the downstream end of the branch passage and located around the downstream end of the atomization-promoting fluid supply passage;

a first connecting passage connecting the downstream end of the atomization-promoting fluid supply passage to the injection holes; and a burner proper having a second connecting passage connecting the downstream end of the liquid fuel supply passage to the annular passage and the side portions of the respective injection holes;

wherein said plurality of injection holes are divided into a plurality of groups, each said group consisting of two injection holes, and said groups being arranged at a plurality of positions on the burner proper separated from one another by predetermined angles in a circumferential direction about a central axis of the burner proper, the central axis of the burner proper comprising a center of said plurality of groups; and said two injection holes of each said group of injection holes being disposed close to one another in the circumferential direction about the central axis of the burner proper.

2. The liquid fuel combustion burner as set forth in claim 1, wherein:

each said injection hole has a central longitudinal axis; and said two injection holes of each group being arranged continuously to each other so that the central longitudinal axes of the injection holes are disposed at at least one of:

a crossing angle smaller than 20°, and parallel to one another.

3. The liquid fuel combustion burner as set forth in claim 1, wherein:

the burner proper comprises a fuel supply member, the fuel supply member having a top end, and a burner tip connected to the top end of the fuel supply member;

the fuel supply member comprising:

the liquid fuel supply passage, the atomization-promoting fluid supply passage, the branch passage and the first connecting passage connecting the atomization-promoting fluid supply passage to the injection holes; and the burner tip comprising:

the plurality of injection holes, the annular passage and the second connecting passage connecting the downstream end of the liquid fuel supply passage to the annular passage.

4. The liquid fuel combustion burner as set forth in claim 3, wherein the fuel supply member is formed of a substantially columnar member having a surface of a circular cone on the top end.

5. The liquid fuel combustion burner as set forth in claim 4, wherein the fuel supply member comprises a top end face and a rear end face; and a liquid fuel supply passage is formed through the top end face and the rear end face portions thereof.

6. The liquid fuel combustion burner as set forth in claim 5, wherein, said liquid fuel supply member has a rear end disposed opposite the downstream end;

said fuel supply member comprises a plurality of branch passages formed in the fuel supply member; and the branch passages extend obliquely upward from the rear end of the liquid fuel supply passage and open to the top end face of the fuel supply member.

7. The liquid fuel combustion burner as set forth in claim 6, wherein the fuel supply member has formed therein, a plurality of small-diameter holes extending obliquely from positions close to the rear end of the liquid fuel supply passage on the rear end face of the fuel supply member and piercing the top end face of the fuel supply member from a direction orthogonal to the rear end face.

8. The liquid fuel combustion burner as set forth in claim 7, wherein:

the burner tip has a rear face for being disposed in engagement with the top end face of the fuel supply member;

at least one of the top end face of the fuel supply member and the rear face of the burner tip comprise an engaging pin driven into the at least one of the rear face of the burner tip and the top end face of the fuel supply member; and the other of the top end face of the fuel supply member and the rear face of the burner tip comprising an engaging hole, the engaging pin for being engaged with the engaging hole to engage the fuel supply member with the burner tip.

9. The liquid fuel combustion burner as set forth in claim 8, wherein the rear end face of the burner tip comprises a recess capable of being engaged with the top end portion of the fuel supply member and the burner tip is formed to have substantially a shape of a circular cone as a whole.

10. The liquid fuel combustion burner as set forth in claim 9, wherein the burner tip has a top end face opposite the rear end face, and the rear end face of the burner tip has a central part and a peripheral part disposed about the central part, the burner tip comprising:

a circular recess formed at the central part of the inner face of the burner tip;

the annular passage formed in the peripheral portion of said inner face; and the plurality of injection holes pierced from the top end face of the burner tip in a direction orthogonal to said top end face and opening to the rear end face between said annular passage and said circular recess.

11. The liquid fuel combustion burner as set forth in claim 10, wherein the second connecting passage comprises, on the inner face of the burner tip:

a first portion between the injection holes and the circular recess formed at a central part of the inner face of the burner tip, the first portion connecting the injection holes and the circular recess; and a second portion formed between the injection holes and the annular passage, the second portion connecting the injection holes to the annular passage.

12. The liquid fuel combustion burner as set forth in claim 10, wherein the second connecting passage comprises, on the top end face of the fuel supply member:

a first portion between the injection holes and a circular recess formed at the central part of the top end face of the fuel supply member, the first portion connecting the injection holes to the circular recess; and a second portion formed between the opening of the injection hole and the annular passage, the second portion connecting the injection hole to the annular passage.

13. The liquid fuel combustion burner as set forth in claim 1, wherein the burner proper comprises a fuel supply member, the fuel supply member having a top end portion, and a burner tip to be engaged with the top end portion of the fuel supply member;

the fuel supply member comprising:

the liquid fuel supply passage, the atomization-promoting fluid supply passage, the branch passage, the first connecting passage connecting the atomization-promoting fluid supply passage and the injection hole, a part of the plurality of injection holes, the annular passage and the second connecting passage connecting the downstream end of the liquid fuel supply passage to the annular passage and injection holes; and the burner tip comprising:

a remainder of the plurality of injection holes.

14. The liquid combustion burner as set forth in claim 13, wherein:

the fuel supply member has a top end face, the top end face having a central part and a peripheral portion disposed about the central part, the fuel supply member comprising:

a circular recess formed at the central part of the top end face of the fuel supply member;

the annular passage formed in the peripheral portion of the top end face of the fuel supply member; and the first connecting passage for connecting the atomization promoting fluid supply passage to the plurality of injection holes pierced from the top end face of the burner tip in a direction orthogonal to said top end face, the first connecting passage being formed between the annular passage and the circular recess.

15. The liquid fuel combustion burner as set forth in claim 14, wherein the second connecting passage comprises a first portion and a second portion, the first portion being formed between the injection holes of the fuel supply member and the circular recess formed at the central part of the fuel supply member to connect the injection holes to the circular recess, and the second portion being formed between the injection holes and the annular passage to connect the injection holes to the annular passage.

16. A method of spraying fluid fuel in a fluid fuel combustion nozzle, said nozzle having a central longitudinal axis and a plurality of flow passages therein, said plurality of flow passages comprising a plurality of groups of flow passages, each of said plurality of groups of flow passages comprising at least two flow passages disposed substantially adjacent one another, and said plurality of groups of flow passages being spaced apart from one another on said nozzle in a circumferential direction about the central longitudinal axis of the nozzle, said method comprising the steps of:

introducing the fluid into the plurality of flow passages of said fluid fuel combustion nozzle;

swirling the fluid fuel in said flow passages;

introducing a division-promoting fluid into said flow passages to divide the fluid fuel and form a mixed fluid of the division-promoting fluid and the fluid fuel; and spraying the mixed fluid out of each of said at least two flow passages of each said group of flow passages to produce a plurality of spaced apart sprays of said mixed fluid, each of said plurality of spaced apart sprays comprising a spray from each of said at least two flow passages of a group of flow passages.

17. The method of spraying fluid fuel according to claim 16, wherein said division-promoting fluid comprises at least one of:

air, steam, and a mist of water drops.

18. The method of spraying fluid fuel according to claim 17, wherein:

each said flow passage defines a longitudinal axis;

said at least two flow passages of a group of flow passages are disposed so that the longitudinal axes of the flow passages are disposed at at least one of:

a crossing angle smaller than 20°, and parallel to one another; and said method further comprises spraying the mixed fluid out of said at least two flow passages of each said group of flow passages at at least one of:

said crossing angle smaller than 20°, and parallel to one another.

19. A fluid fuel spray nozzle for use in a boiler, a heating furnace of the like, said fluid fuel spray nozzle having a longitudinal axis and said fluid fuel spray nozzle comprising:

at least one first supply passage for providing fluid fuel;

at least one second supply passage for providing a fluid for dividing said fluid fuel into reduced size particles;

at least one injection passage aligned with and connected to said at least one second supply passage;

at least one connecting passage connecting said at least one first passage to said at least on injection passage, said at least one connecting passage being substantially tangentially connected to said at least one injection passage;

at least one of:

said at least one connecting passage, and said at least one injection passage comprising means for producing swirling of the fluid fuel upon the fluid fuel being introduced into said injection passage through said at least one connecting passage from said at least one first supply passage;

said at least one injection passage comprising a plurality of injection passages;

said plurality of injection passages comprising a plurality of groups of said plurality of injection passages;

each of said plurality of groups of injection passages comprising at least two said injection passages;

said at least two injection passages of each of said plurality of groups of injection passages being disposed substantially adjacent to one another; and each of said plurality of groups of injection passages being spaced apart from another of said plurality of groups of injection passages at a predetermined angle in a circumferential direction about the longitudinal axis of the nozzle.

20. The fluid fuel spray nozzle according to claim 19, wherein:

each of said injection passages defines a longitudinal axis; and said at least two injection passages of each of said plurality of groups of injection passages are circumferentially spaced apart from one another with the longitudinal axis of one of said injection passages disposed at an angle of less than 20° with the longitudinal axis of another of said injection passages.

21. The fluid fuel spray nozzle according to claim 10, wherein said plurality of groups of injection passages comprise three groups of injection passages disposed in a circumferential direction from one another at an angle of 120°.

* * * * *

UNITED STATES PATENT AND TRADEMARK OFFICE

CERTIFICATE OF CORRECTION

PATENT NO. : 5,158,443

DATED : October 27, 1992

INVENTOR(S) : Tuneo MIYAKE

It is certified that error appears in the above-identified patent and that said Letters Patent is hereby corrected as shown below:

In column 11, line 58, after 'Another', insert --embodiment--.

In column 16, line 59, Claim 19, after the second occurrence of 'least', delete "on" and insert --one--.

In column 17, line 12, Claim 19, after 'adjacent', delete "to".

Col. 18, line 12, Claim 21, after 'claim', delete "10" and insert --20--.

Signed and Sealed this

Twenty-sixth Day of October, 1993

*Attest:*

Bruce Lehman

BRUCE LEHMAN

*Attesting Officer*

*Commissioner of Patents and Trademarks*